United States Patent [19]

Pinson

[11] 4,275,537

[45] Jun. 30, 1981

[54] TENSION MEMBERS

[75] Inventor: Neal I. Pinson, Beaverton, Oreg.

[73] Assignee: Tension Structures, Inc., El Cajon, Calif.

[21] Appl. No.: 961,268

[22] Filed: Nov. 16, 1978

Related U.S. Application Data

[63] Continuation of Ser. No. 800,622, May 26, 1977, abandoned.

[51] Int. Cl.[3] ..... E04C 3/10

[52] U.S. Cl. ..... 52/223 R; 52/223 L; 52/227; 52/642; 52/644; 52/691; 52/693

[58] Field of Search ..... 52/223 R, 227, 642, 52/644, 691, 229, 223 L, 225

[56] References Cited

U.S. PATENT DOCUMENTS

| | | | |
|---|---|---|---|
| 1,012,423 | 12/1911 | Orr | 52/227 X |
| 1,762,363 | 6/1930 | Sergent | 52/642 X |
| 1,791,656 | 2/1931 | Brancart . | |
| 1,926,202 | 9/1933 | Kelly . | |
| 1,973,882 | 9/1934 | Pratt . | |
| 2,333,136 | 11/1943 | Wolford | 52/640 |
| 2,601,910 | 7/1952 | Nichols | 52/223 R |
| 2,618,148 | 11/1952 | Reed | 52/229 |
| 2,760,450 | 8/1956 | Findleton . | |
| 2,770,846 | 11/1956 | Findleton . | |
| 2,809,074 | 10/1957 | McDonald . | |
| 2,874,812 | 2/1959 | Clevett, Jr. | 52/227 |
| 2,877,506 | 3/1959 | Almoslino . | |
| 3,140,764 | 7/1964 | Cheslein | 52/223 R |
| 3,247,635 | 4/1966 | Burns | 52/223 L |
| 3,251,162 | 5/1966 | Strimple | 52/223 R |
| 3,333,375 | 8/1967 | Johnston | 52/81 |
| 3,810,337 | 5/1974 | Pollard | 52/223 R |

FOREIGN PATENT DOCUMENTS

| | | | |
|---|---|---|---|
| 234335 | 6/1964 | Austria | 52/223 R |
| 589547 | 12/1959 | Canada | 52/228 |
| 73316 | of 0000 | Denmark | 52/227 |
| 1464818 | 1/1967 | France . | |
| 1256359 | 12/1971 | United Kingdom | 52/223 R |

*Primary Examiner*—Price C. Faw, Jr.
*Assistant Examiner*—Carl D. Friedman
*Attorney, Agent, or Firm*—Klarquist, Sparkman, Campbell, Leigh, Whinston & Dellett

[57] ABSTRACT

Prestressed composite tension members comprise an assembly which includes compression and tension portions which are loaded longitudinally along or symmetrical with the center of gravity of the compression portion and prestressed causing both the tension and compression portions to cooperate in resisting lengthening of the assembly rather than the tension portion alone, thus lessening such elongations. In one embodiment, the tension member forms a tension member in a truss, having an upper chord and vertical webs acting in compression, and the tension member comprises a tensioned cable mounted within a series of abutting, slotted and glued wood members under compression. In another embodiment, the tension member comprises a tensioned cable centered in a plurality of tubes in compression, forming the truss lower chord. In another truss, the lower chord consists of the tension member comprised of a tensioned cable centered in a slotted wood member under compression with the end cable grips bearing on a bearing plate at the end of the compression member. In another truss lower chord, the tension member consists of a tensioned cable centered in a slotted wood member under compression with the end cable grips bearing on a plate at the end of the truss heel assembly. In another truss embodiment, the tension member comprises a tensioned, high strength, steel strap encircling the sides and ends of the wood compression member. In another embodiment, the tension member comprises tensioned cables centered in a slotted, glued-laminated compression member, such tension member forming the main structural elements of the roof system. In another, a plurality of tension members having tensioned cable cores and tubes in compression and connecting a central ring to an outer ring create a tension structure. In another embodiment, a tension-compression structure is created and comprises a tensioned cable centered in a slotted, glued-laminated, compression portion. In another embodiment, a mechanism, capable of supporting a substantial load at its end, comprises metal tubes abutting a high friction material abutting spherical balls allowing mobility and the ability to assume many different positions.

9 Claims, 31 Drawing Figures

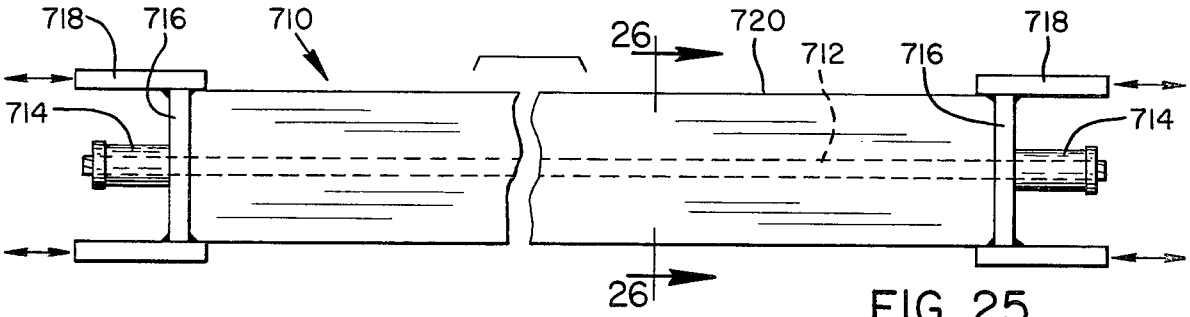
FIG. 25
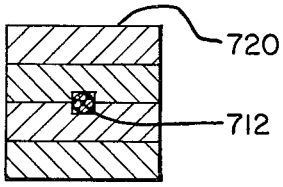
FIG. 26
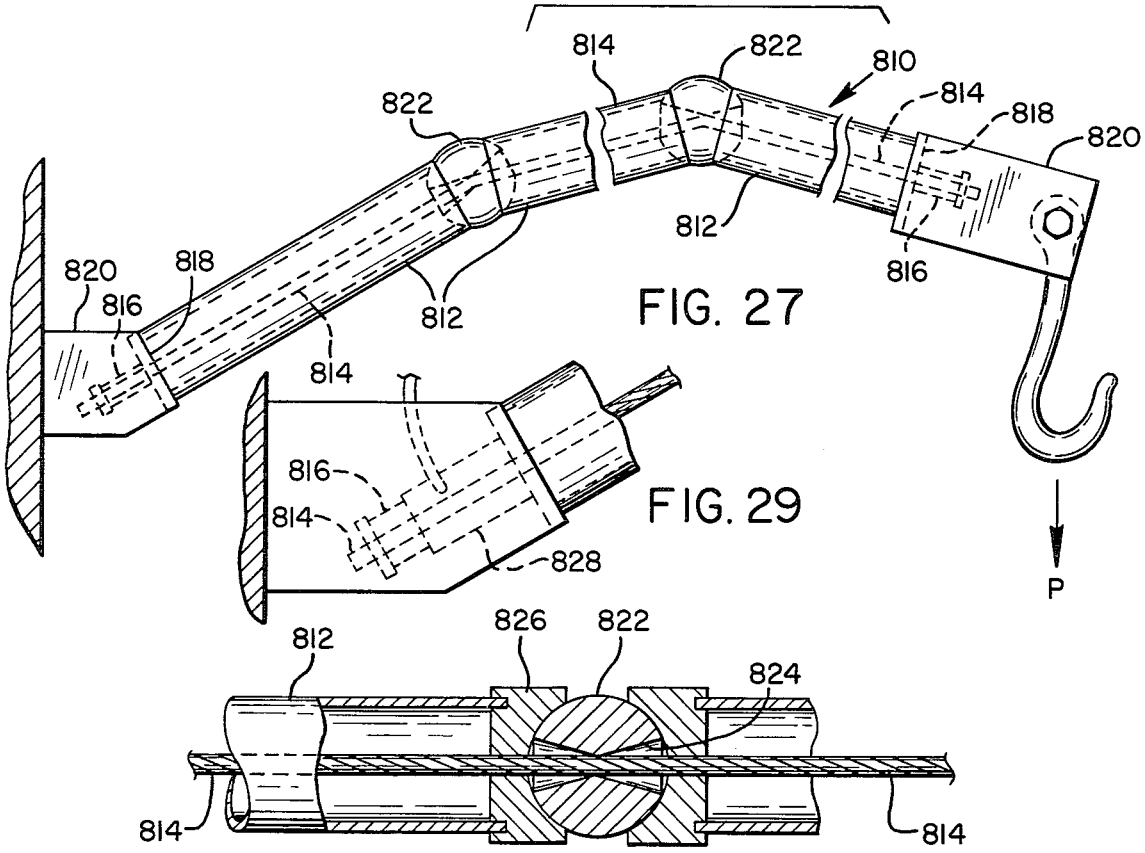
FIG. 27
FIG. 29
FIG. 28

TENSION MEMBERS

This is a continuation of application Ser. No. 800,622, filed May 26, 1977, now abandoned.

DESCRIPTION

This invention relates to improved prestressed, composite, tension members, and has for an object thereof the provision of new and improved prestressed, composite, tension members.

Another object of the invention is to provide a composite, truss, tension member loaded longitudinally along and symmetrical with its center of gravity.

A further object of the invention is to provide a composite tension member, including one or more tensioned cables located at or symmetrical with the center of gravity of a compression portion under compression, and preferably having a product of its cross-sectional area and modulus of elasticity several times that of the cable, so that the combined effect is greatly reduced lengthening of the tension member.

Another object of the invention is to provide improved "cable supported" structures relying principally on tension members and having increased dynamic stability, reduced vertical deflections, greater structural reliability and less cost.

Another object of the invention is to provide improved trusses having reduced vertical truss deflections, simplified web and chord connections, increased structural reliability and reduced costs.

Another object of the invention is to provide an improved tension member, which can also be used as a compression member, including a compression portion and a tension portion preloaded concentrically with the center of gravity of the compression portion.

Another object of the invention is to provide an improved tension member including a compression portion and a tension portion preloaded concentrically with the center of gravity of the compression portion.

Another object of the invention is to provide a composite tension member having one or more tensioned cables and a plurality of pairs of straight or curved structural members compressed in end abutment with each other and having grooves or other suitable means for longitudinal passage of the cables.

Another object of the invention is to utilize a composite tension member having outer, tubular compression members held in compression against spherical or other suitable joints by one or more tensioned cables extending concentrically through or about the tubes and the joints to create a tension supported structure.

Another object of the invention is to provide a composite tension member having a tensioned, suitably spliced, high strength steel strap or straps encircling the sides and ends of the compression portion.

Another object of the invention is to provide a composite tension member having curved glued laminated wood or other suitable structural compression members held in compression by one or more tensioned cables extending concentrically with the center of gravity through or about the compression member to create a tension supported structure.

Another object of the invention is to provide a mechanism capable of supporting a substantial load at its end, comprising metal tubes abutting a high friction material abutting spherical balls, held in compression by one or more tensioned cables allowing mobility and the ability to assume many different positions.

Figure 22:
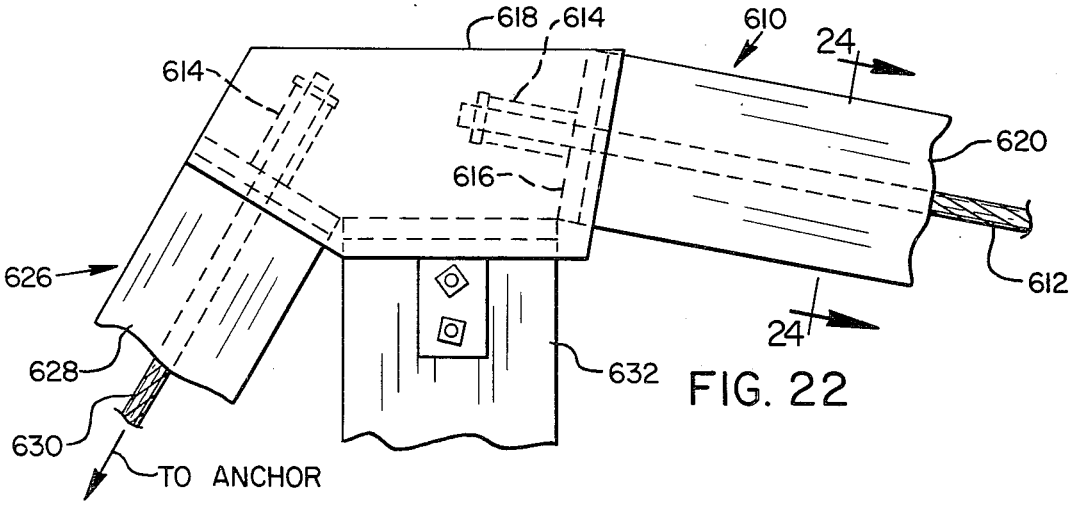
FIG. 22 is an enlarged, fragmentary view of the tension structure of FIG. 21 at exterior vertical support.
Figure 23:
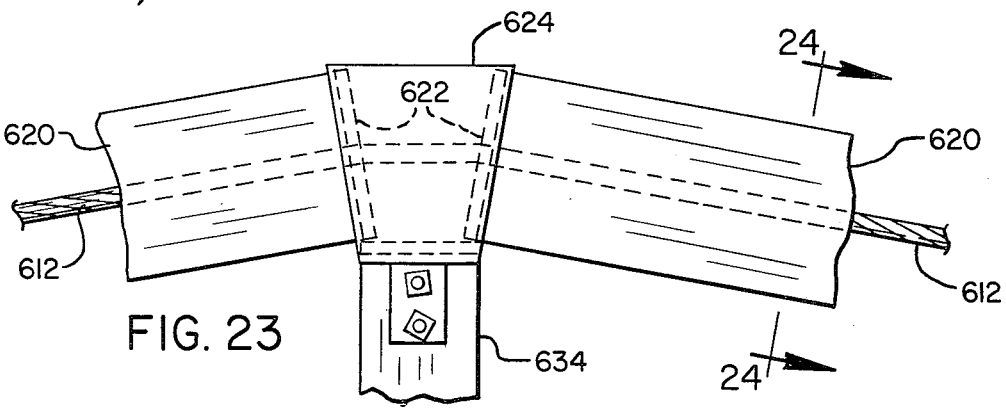
FIG. 23 is an enlarged, fragmentary view of the tension structure of FIG. 21 at interior support.
Figure 23A:
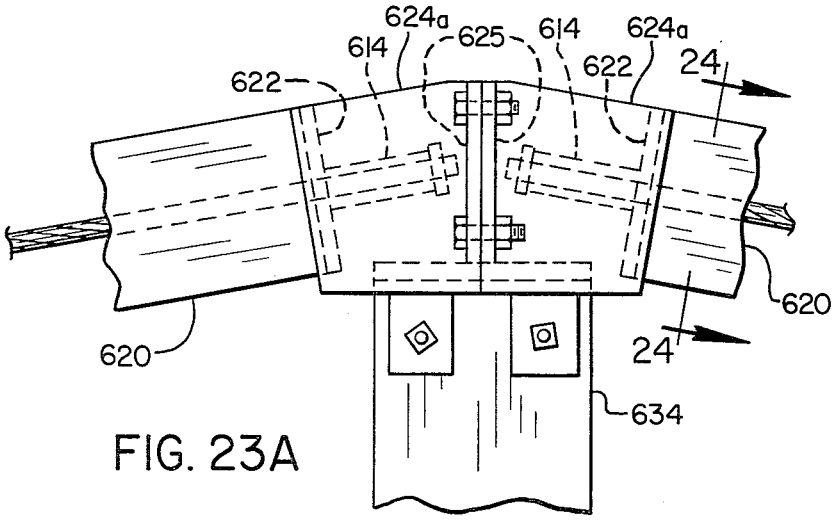
Figure 24:
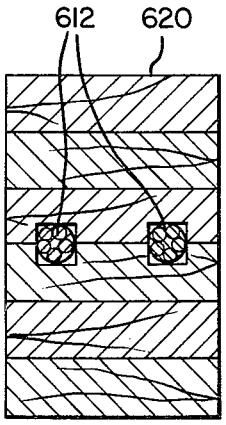

FIG. 23*a* is an alternate detail to FIG. 23;

FIG. 24 is an enlarged, vertical, sectional view taken along line 24—24 of FIG. 22, FIG. 23 or FIG. 23*a;*

FIG. 25 is a side elevation view of an improved tension member, which can also be used as a compression member, forming one embodiment of the invention;

FIG. 26 is an enlarged, fragmentary view of the tension-compression member taken along line 26—26 of FIG. 25;

FIG. 27 is a side elevation view of an improved mechanism forming one embodiment of the invention;

FIG. 28 is an enlarged, fragmentary view of the mechanism of FIG. 27; and, FIG. 29 is an enlarged, fragmentary side elevation view of the mechanism of FIG. 27.

EMBODIMENT OF FIGS. 1-3a

A truss 10 (FIGS. 1-3a) forming a specific embodiment of the invention includes an upper, compression chord 12, which may be made of any suitable structural material, that shown being a wood beam, formed in a straight line. The upper chord could also be slightly cambered or raised significantly above the horizontal in one or more straight or curved sections, and consist of one or more pieces straight or curved. A truss lower chord 14 comprises a specific embodiment of the invention and, in this case, essentially takes the shape of the funicular polygon resulting from the amounts and locations of loads which the truss will support in service. The lower chord 14 is, in totality, a tension member and consists of two parts: a compression portion 16, which is prestressed by a tension portion 18 comprising a steel cable. The tension portion 18 is prestressed to compress the compression portion 16 and resists all tensile forces induced in the lower chord 14. The compression portion 16 may be made of any suitable structural material, such as wood, steel or concrete, or a combination of such materials, and includes end segments 20 and intermediate segments 22. The segments 20 and 22 shown are pairs of wood beams glued, strapped or otherwise suitably fastened together. The tension portion 18 may also be made of single or multiple pieces of any suitable structural material, such as high strength steel in the form of a strand, rod, strap, cable, rope, bar or other as desired. The tension portion 18 may also be of single or multiple pieces placed internally, externally, or a combination thereof to act essentially at the center of gravity of the compression portion. During truss assembly, the tension portion 18 is prestressed against the compression portion 16 of the lower chord 14 to the amount, more or less, that the truss lower chord 14 will be stressed under the full load to be supported by the truss. This prestressing shortens the compression portion 16 and lengthens the tension portion 18, thus reaching equilibrium between the two parts 16 and 18 with little or no stress induced in the upper chord 12.

Wood webs 30, which are compression members, are secured to the sections 20 and 22 and the upper chord 12 by tie plates 32 and screws, nails or bolts 33. Various configurations of toothed truss plates embedded in the wood may also be used. The end sections 20 are secured to connectors 34. The chord 12 abuts the abutments 40 which are welded to straps 38 and is secured to the straps 38 by bolts 42. The sections 20 abut plates 44 welded to the straps 38, which have a bridge portion 46 welded thereto. The sections 20 and 22 abut plates 54 to provide adequate end bearing. Plates 52 are inserted in slots 50 to provide greater allowable cable pressure against compression sections 20 and 22 at their juncture. The cable 18 is held under tension by known commercially available grips or cable clamps 48 which abut the plates 44.

In service, as external design loads occur on the truss, the truss as a whole deflects, shortening the upper chord 12 and lengthening the lower chord 14. As the lower chord lengthens under load, the compression portion 16 and the tension portion 18 both lengthen the same amount. As the parts lengthen together, the unit compressive stress in the compression portion 16, stored during prestressing, is reduced in direct proportion to its cross-sectional area and modulus of elasticity, and the unit tensile stress in the tension portion 18 is increased in direct proportion to its cross-sectional area and modulus of elasticity. Since the product of cross-sectional area and modulus of elasticity of the compression portion 16 is usually several times greater than the product of cross-sectional area and modulus of elasticity of the tension portion 18, the compression portion 16 gives up compressive stress at a rate several times faster than the tension portion 18 increases in stress. Also, since the lengthening of both the compression portion and the tension portion is minimized due to the effect of the compression portion being active in reducing deflection, the tension portion is extended but little and, therefore, increased stress in the tension portion is small and may be calculated. The important point here is that the compression and tension portions act together and essentially readjust their stresses when load is applied to the truss, one releasing compressive stress and the other gaining tensile stress. In this way, they act in concert as if their ends were perfectly bonded to the end brackets in such a way that tensile loads applied to the brackets are fully transmitted to both portions. This "perfect bonding" results from the prestressing operation and is effective as long as any compressive stress remains in the compression portion 16. In practice, tension members would be designed so that compressive stress would always remain in the compression portion 16 at full design load. The combined stiffness properties (cross-sectional area times modulus of elasticity) of these portions thus cooperate to resist lengthening of the truss lower chord 14 with the net benefit of reducing the deflection of the truss as a whole.

This invention is equally applicable and useful in supporting all vertical loads, reducing deflection and dynamically stabilizing "cable-supported" structure against wind and/or other forces. As in the truss lower chord previously described, the compression portion and the tension portion work together as one composite piece with the combined areas and respective modulii of elasticity working together to resist lengthening or shortening of the assembly and thus reduce the vertical deflection of the cable-supported structure as a whole. When the invention is used for the construction of trusses of the type shown in FIG. 1, all truss stresses are in compression except the tension portion 18 of the lower chord 14 and, therefore, no tension splices are required in the lower chord, thus reducing cost over present methods.

Another important principle embodiment in the invention, is that the two-part structural tension member 14 of any length is completely stable against critical compression buckling due to prestressing; as long as the tension portion 18 is essentially in continuous lateral contact with the compression portion 16; or the tension portion 18 is fastened to the compression portion 16 at intervals, to prevent lateral deflection, which would limit stresses in the compression portion 16 to less than the critical buckling stress.

Using this invention, trusses have been designed to have an overall depth of 1/16 to 1/20 of the span and well within deflection restrictions required by building codes, although, as with any beam or truss, greater depth reduces both induced stresses and deflection. The truss of the type shown in FIG. 1 does not require web members which are intersecting with each other and the lower and/or upper chords to form a system of triangles, although such a system of triangles may also be used.

EMBODIMENT OF FIGS. 4-6

A truss 110 forming an alternate embodiment of the invention, includes a compression chord 112 of wood and a prestressed tension member 114 comprising a steel cable 118 held under tension by grips 148 abutting plates 144 of connectors 134. The compression portion 120 comprises steel tubes abutting the plates 144 and split spherical balls 152 having tapered passages 154 through which the cable extends and which center the cable in the tubes. Channel-like webs 155 have base portions 158 positioned between the halves of the spheres 152, and the cable extends through holes 156 in the webs. Bolts 142 connect straps 138 of the connectors to the upper chord. Bearing plate portion 146 connects the straps 138 together. The cable is initially tensioned to compress the tubes 120 to the amount, more or less, that the truss lower chord 120 will be stressed when external loads are applied to the truss.

In order to support a horizontal ceiling, members of appropriate size may be suspended from the truss verticals and large open areas bounded by adjacent verticals and the upper and lower chords provide adequate space for such as ductwork and piping of various kinds. Such ceiling framing members may also be fastened alongside the lower chord of the truss in order to not increase the effective depth of the truss. In addition, suspended ceilings may be attached to the truss or to members supported by the truss.

EMBODIMENT OF FIGS. 7-9

A building structure 210 forming an alternate embodiment of the invention includes an outer ring 212 and an inner ring 213 secured together by novel tension members 214. Each tension member 214 includes a pretensioned cable or tension portion 218 and a plurality of compression portions 216 comprising tubular sections 216 abutting hemispheres 252 abutting each other and the rings 212 and 213. Hemispheres 252 align the tubes and centrally position the cable. Cable clamps or grips 248 clamp the cables and hold them in tension.

EMBODIMENT OF FIGS. 10-13

A truss 310 forming an alternate embodiment of the invention includes a compression chord 312 of wood and a prestressed tension member 314 comprising a steel cable 316 held under tension by grips 318 abutting plates 320. The compression portion 322 comprises a slotted wood member of one or more pieces abutting plates 320 near the truss ends and abutting plates 324 at interior compression portion ends. Plates 324 have a hole or slot to allow passage of the steel cable 316. Toothed truss plates 328 are pressed into wood webs 326, posts 327 and chords 312 and 314 to resist all induced forces.

EMBODIMENT OF FIGS. 14-17

A truss 410 forming an alternate embodiment of the invention includes a compression chord 412 of wood and a prestressed tension member 414 comprising a steel cable 416 held under tension by grips 418 abutting plates 420 of connectors 422. The compression portion 424 comprises a slotted wood member of one or more pieces abutting plates 420 near the truss ends and abutting plates 426 at interior compression portion ends. Plates 426 have a hole or slot to allow passage of the steel cable 416. Toothed truss plates 428 are pressed into wood webs 430 and 432 and chords 412 and 414 to resist all induced forces. The lower end of web 432 abuts plate 434 of connector 422 and is fastened thereto by bolt 436.

EMBODIMENT OF FIGS. 18-20

A truss 510 forming an alternate embodiment of the invention includes a compression chord 512 of wood and a prestressed tension member 514 comprising a high strength steel strap encircling the ends and sides of the compression portion 516. The compression portion 516 comprises a wood member of one or more pieces abutting the tension portion 518 at the truss ends and abutting plates 520 at interior compression portion ends. The tension portion is installed and prestressed after the toothed truss plates 522 are pressed into the wood webs 524 and 526 and chords 512 and 514.

EMBODIMENT OF FIGS. 21-24

An improved tension structure 610 forming an alternate embodiment of the invention includes a prestressed tension member 610 comprising high strength steel cables 612 held under tension by grips 614 abutting plates 616 of connectors 618 at the exterior ends. The compression portion 620 comprises a glued laminated wood member of one or more pieces curved to fit as closely as practical the funicular polygon resulting from external loads applied to the structure. The compression portion 620 is also slotted to accommodate the passage of the steel cables 612. At interior supports the compression portion 620 abuts plates 622 of connectors 624. At the exterior ends of the tension structure 610 a straight prestressed tension-compression member 626 consisting of compression portion 628 and tension portion 630 is suitably anchored to resist all induced forces from structure 610. At all vertical supports members 632 and 634 are provided to resist all vertical forces from structure 610. An alternate connector 624*a* is shown in FIG. 23A and comprises plates 622 each carried by a bracket half 625 bolted to the other bracket half and fitting over the top of post 634.

EMBODIMENT OF FIGS. 25-26

An improved tension-compression structure 710 forming an alternate embodiment of the invention includes a prestressed tension portion 712 comprising a high strength steel cable 712 held under tension by grips 714 and abutment plates 716 of connectors 718 at the ends. The compression portion 720 comprises a glued-laminated member of one or more pieces slotted to accommodate the passage of the steel cable 712. The compression portion 720 is designed to resist externally applied longitudinal compressive forces in addition to resisting internal forces due to prestressing. Thus, the tension-compression structure 710 does not require expensive end connections to resist tensile forces and can effectively resist both tensile and compressive forces induced by external loads.

EMBODIMENT OF FIGS. 27-29

A mechanism 810 forming an alternate embodiment of the invention includes a compression portion 812 and a prestressed tension portion 814 comprising a steel cable 814 held under tension by grips 816 abutting plate 818 of a connector 820 and a hydraulic cylinder drive 828 forming a force multiplying mechanism. The compression portion 812 also includes connectors 826 and abutting spherical balls 822 having tapered passages 824 through which the cable extends and which center the cable in the tubes. The compression portion 812 also comprises metal tubes abutting connectors 826 made of a suitable high friction material, or the compression portion 812 could abut the spherical balls 822 directly where adequate friction is available between 812 and 822. The primary purpose of this embodiment is to create a mechanism capable of supporting a substantial load at its end, permitting mobility and the ability to assume many different positions.

The advantages of the invention are many and are not limited to the following:

1. When used for the design and construction of trusses:

Ability to accommodate an almost unlimited combination of span, spacing and loading conditions with a wide variety of truss shapes and depths.

Ability to be used as roof or floor trusses and provide for ceiling support while providing space between the ceiling and floor or roof for ducts or piping.

Reliability, structural integrity and economy of the system because a combination of materials may be used—each to its best advantage. For example, wood compression members and steel tension members may be used.

Simple, inexpensive connections of all web and chord members and to the ceiling supporting members.

Ease of fabrication and assembly.

Trusses may be fabricated at one point, shipped K.D. to any destination and easily assembled at the jobsite.

Cost of the assembled trusses should be significantly lower than other types now in use because no expensive tension splices or connections are needed to resist tensile forces.

Represents a new approach to truss design and hence will provide many promotional possibilities.

Capable of rational engineering analysis.

2. When used in cable-supported structures:

Increased dynamic stability of the structure.

Reduced vertical deflections of the structure.

Increased structural reliability.

Ease of assembly and erection.

Capable of rational engineering analysis.

Reduced costs.

Figures 1, 2, 3, 3A:
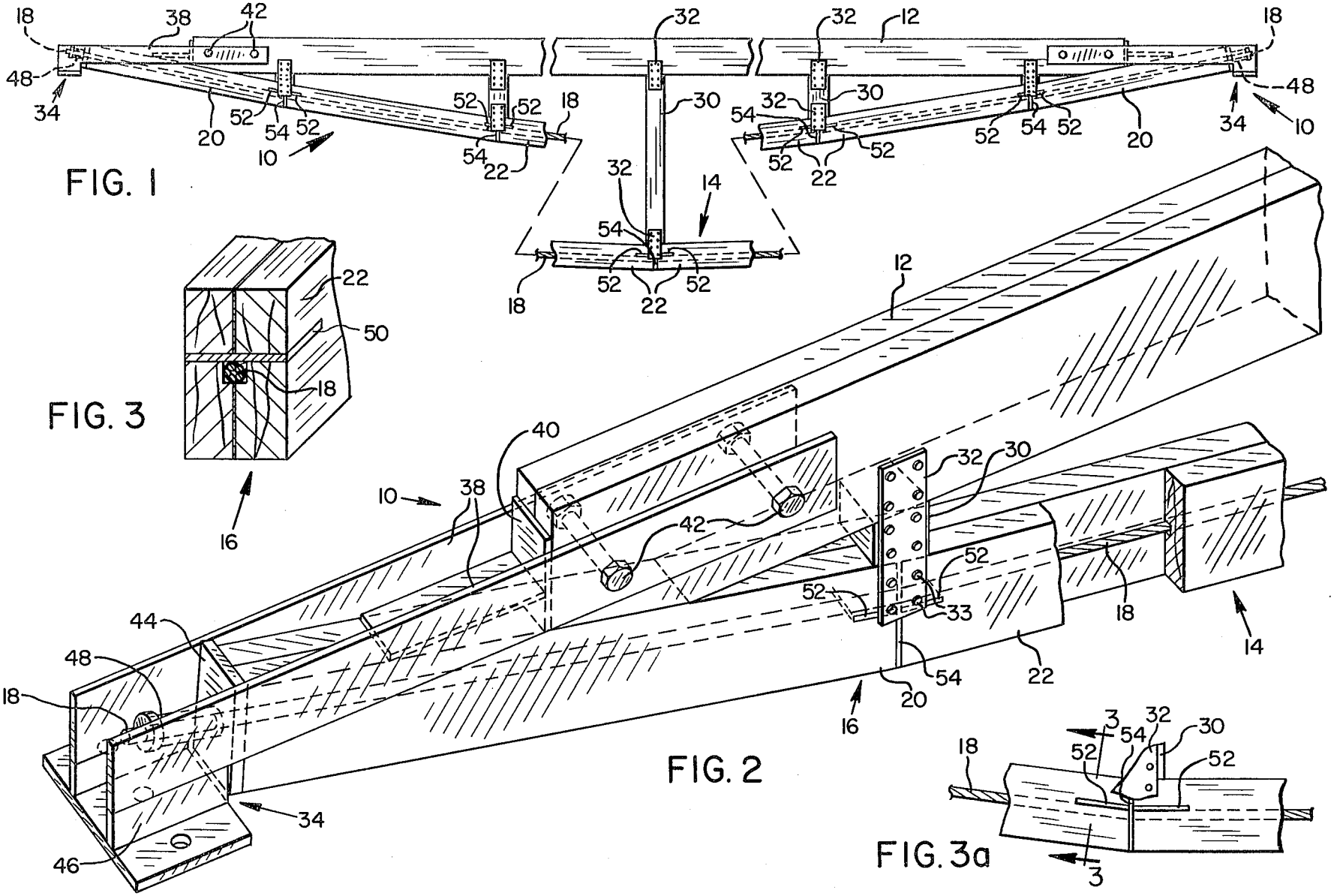
FIG. 1 is a fragmentary, side elevation view of an improved truss forming one embodiment of the invention.
FIG. 2 is an enlarged, fragmentary, perspective view of the truss of FIG. 1.
FIG. 3 is an enlarged, vertical, sectional view taken along line 3—3 of FIG. 3*a* and turned to make it a perspective view
FIG. 3*a* is an enlarged, fragmentary, side elevation view of FIG. 3.
Figure 4:
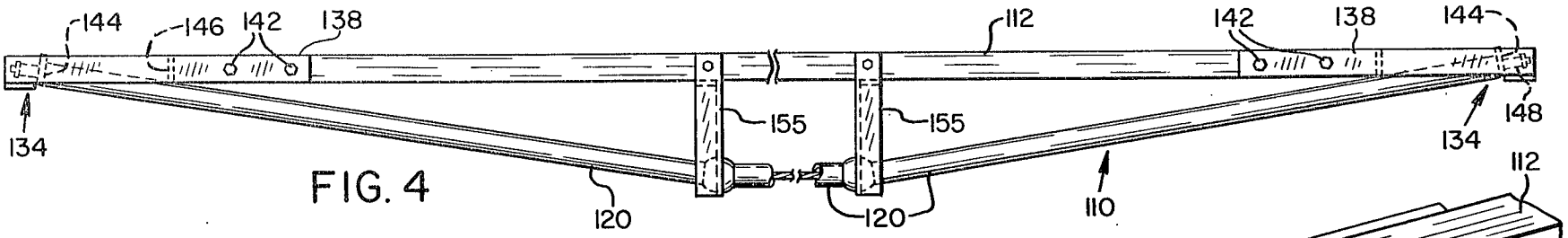
FIG. 4 is a fragmentary, side elevation view of an improved truss forming an alternate embodiment of the invention.
Figure 5:
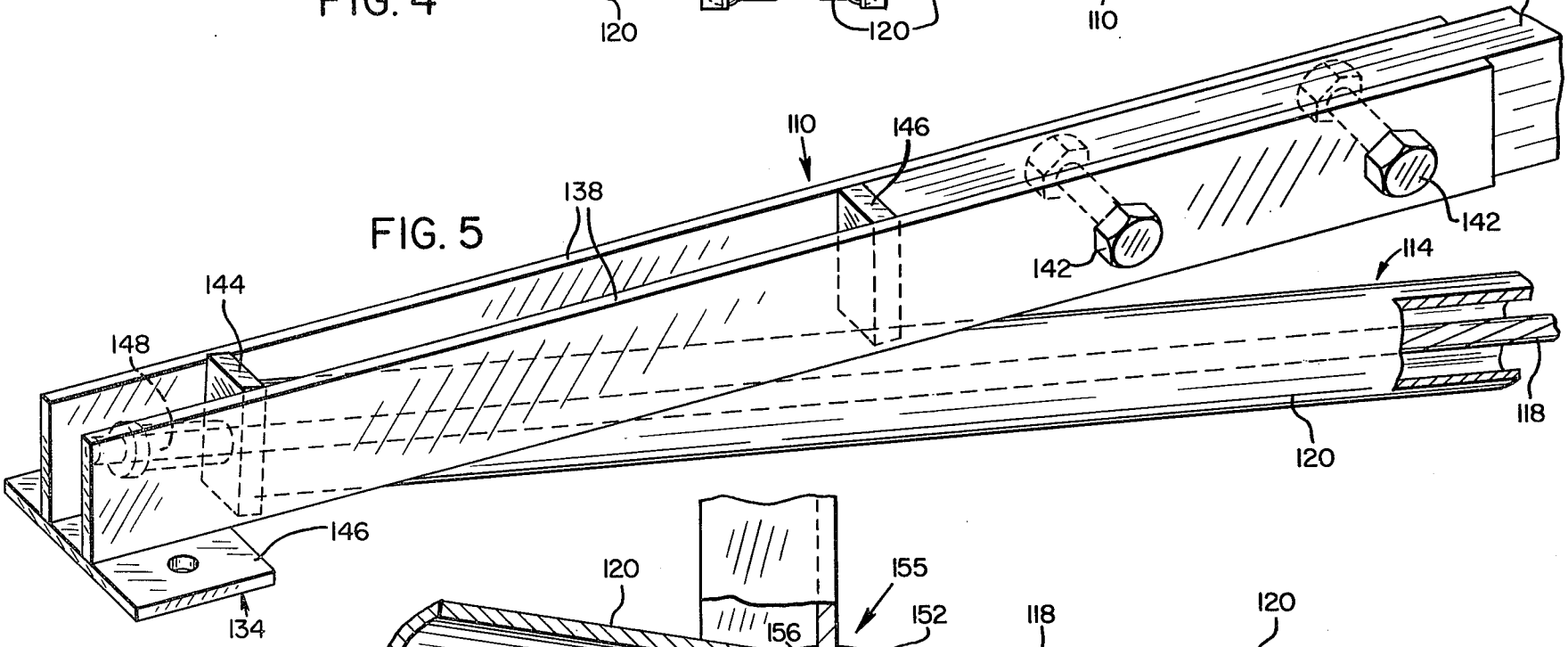
FIG. 5 is an enlarged, fragmentary, perspective view of the truss of FIG. 4.
Figure 6:
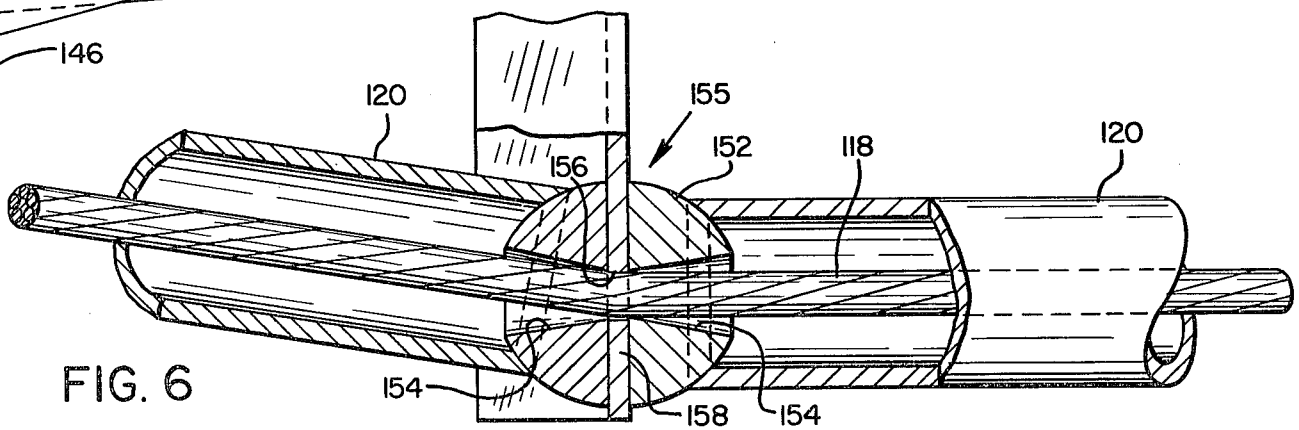
FIG. 6 is an enlarged, fragmentary, longitudinal, sectional view of a portion of the truss of FIG. 4.
Figure 7:
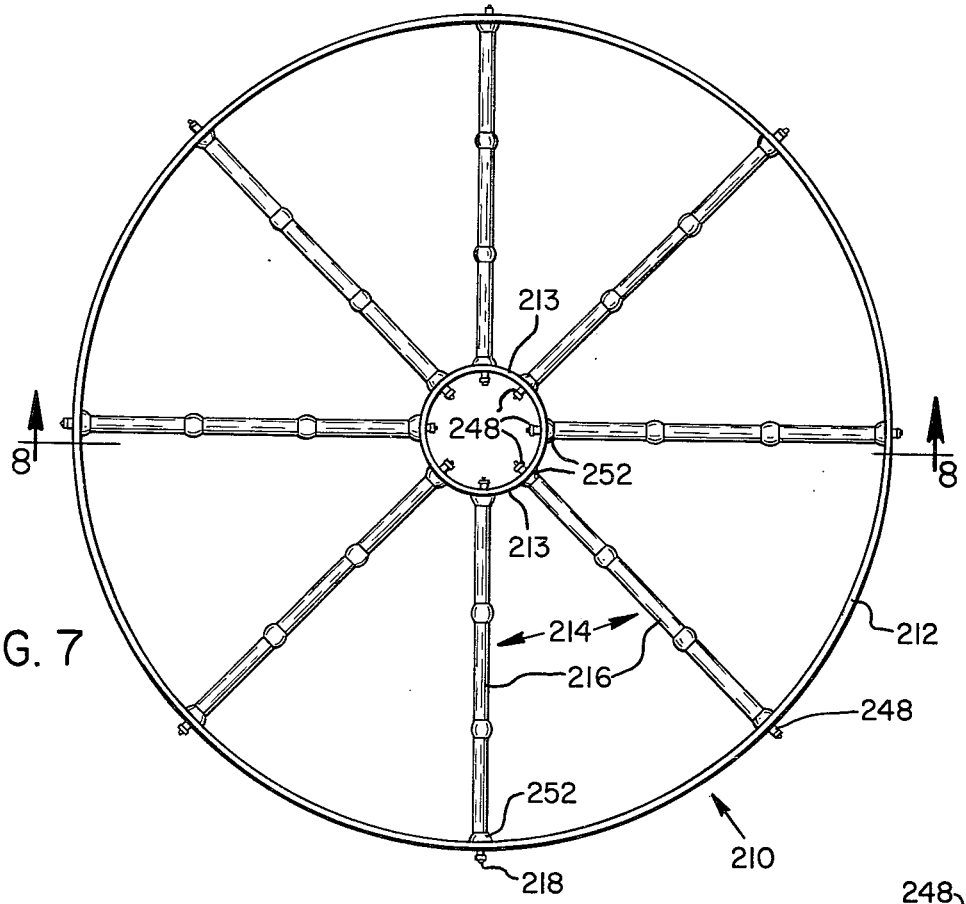
FIG. 7 is a top plan view of a building structure forming an alternate embodiment of the invention.
Figure 8:
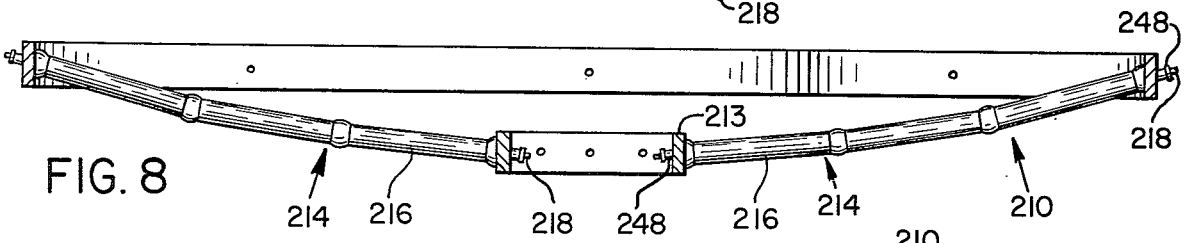
FIG. 8 is an enlarged, vertical, sectional view taken along line 8—8 of FIG. 7.
Figure 9:
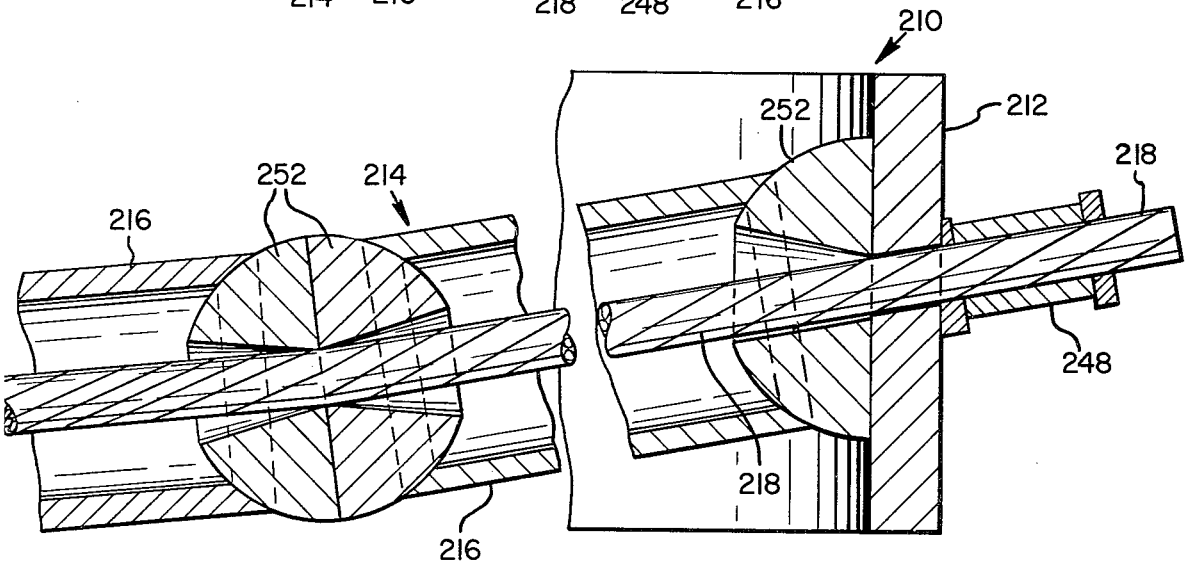
FIG. 9 is an enlarged, fragmentary, vertical, sectional view of the building structure of FIG. 7.
Figure 10:
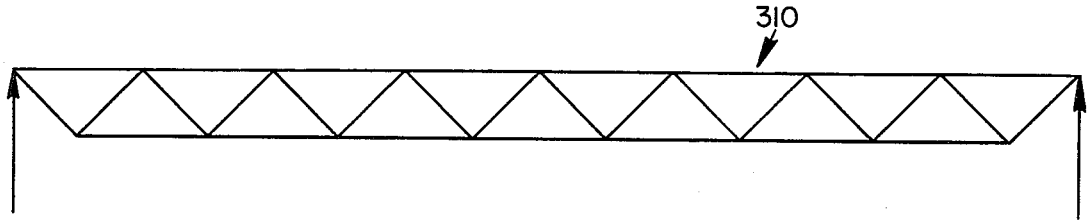
FIG. 10 is a diagrammatic sketch of an improved truss forming one embodiment of the invention.
Figure 11:
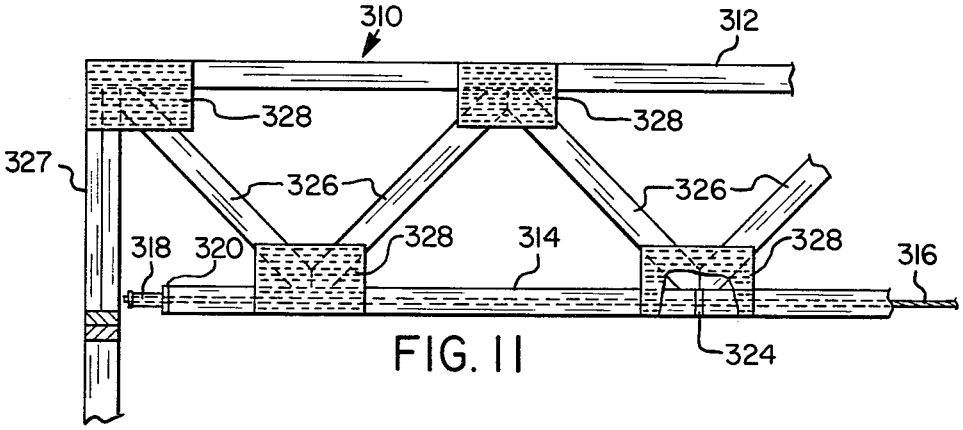
FIG. 11 is a fragmentary side elevation view of the truss of FIG. 10.
Figure 12:
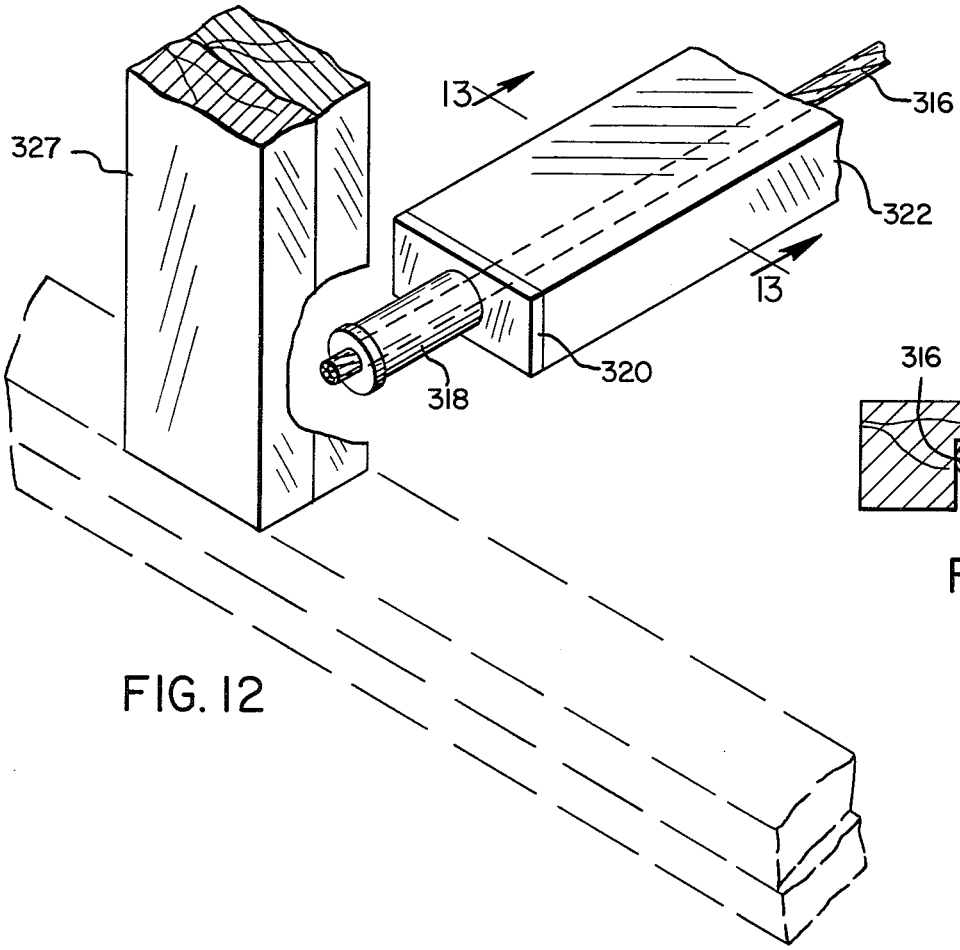
FIG. 12 is an enlarged, fragmentary, perspective view of the truss of FIGS. 10 and 11.
Figure 13:
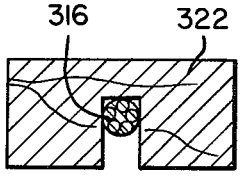
FIG. 13 is an enlarged, vertical, sectional view taken along line 13—13 of FIG. 12.
Figure 14:
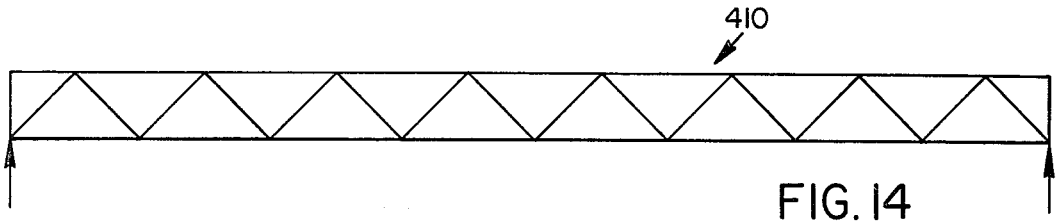
FIG. 14 is a diagrammatic sketch of an improved truss forming one embodiment of the invention.
Figure 15:
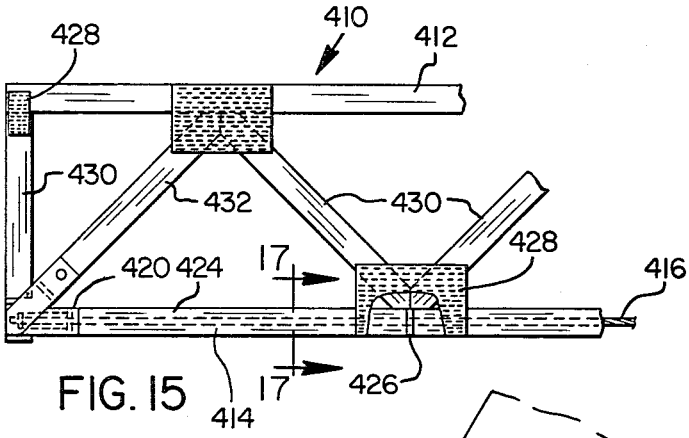
FIG. 15 is a fragmentary, side, elevation view of the truss of FIG. 14.
Figure 16:
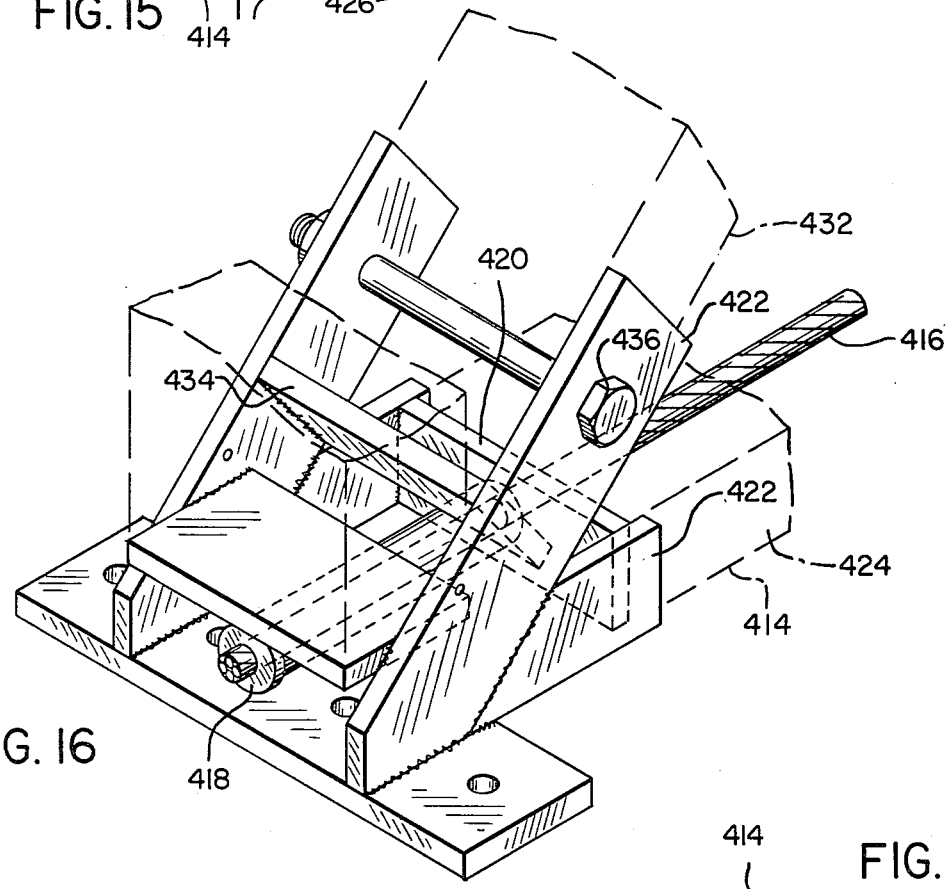
FIG. 16 is an enlarged, fragmentary, perspective view of the truss of FIGS. 14 and 15.
Figure 17:
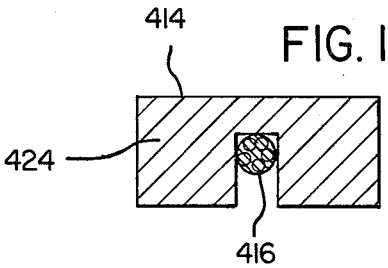
FIG. 17 is an enlarged, vertical, sectional view taken along line 17—17 of FIG. 15.
Figure 18:
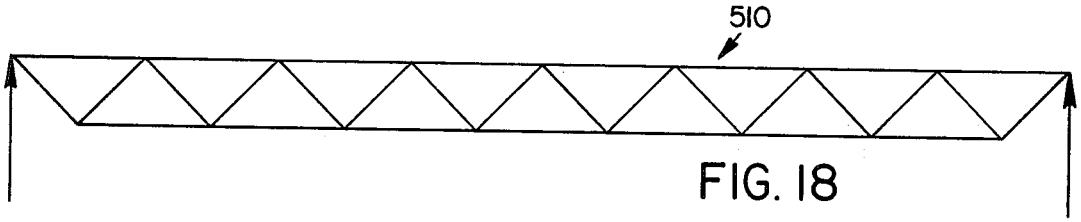
FIG. 18 is a diagrammatic sketch of an improved truss forming one embodiment of the invention.
Figure 19:
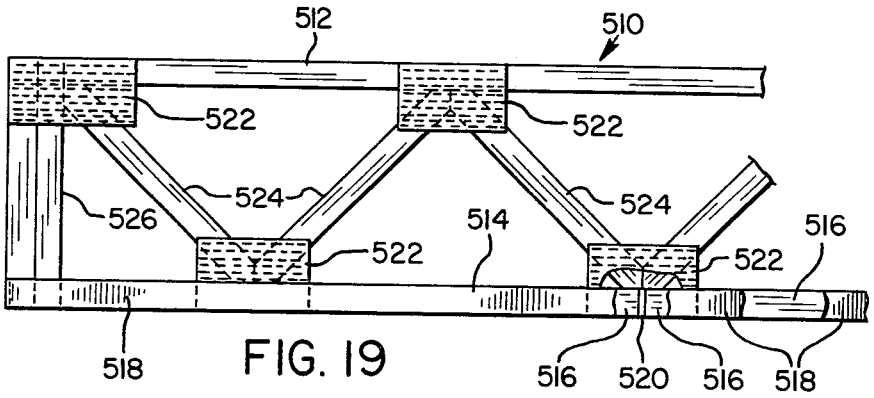
FIG. 19 is a fragmentary side elevation view of the truss of FIG. 18.
Figure 20:
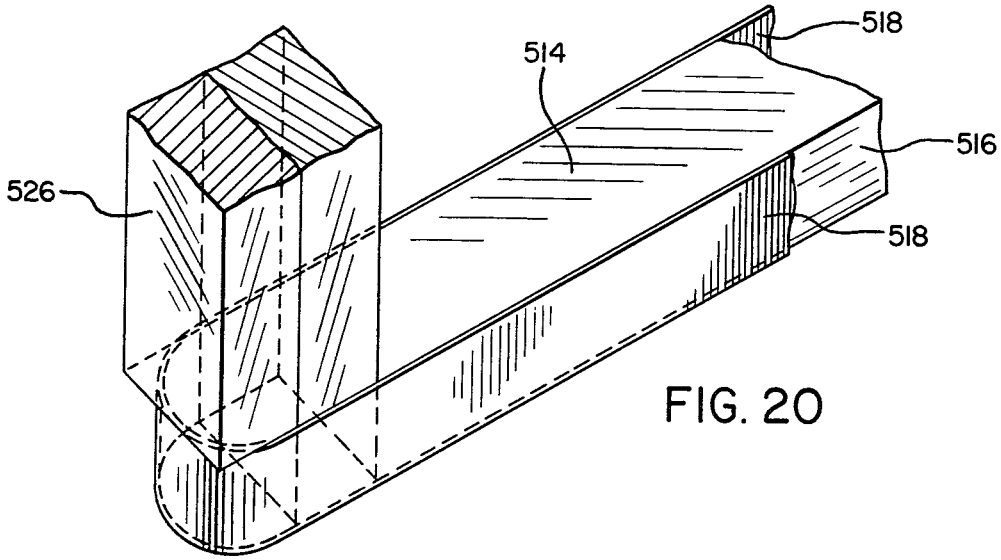
FIG. 20 is an enlarged, fragmentary, perspective view of the truss of FIGS. 18 and 19.
Figure 21:
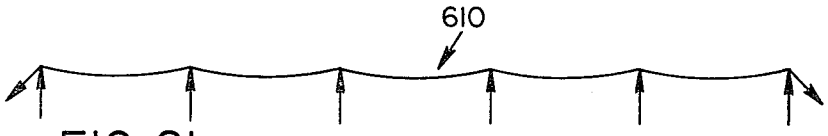
FIG. 21 is a diagrammatic sketch of an improved tension structure forming one embodiment of the invention.

A model of the truss (FIGS. 4–6), ten-foot span, was tested extensively, and the results conclusively prove the theory and structural reliability of the invention. Detailed calculations of theoretical deflections under a variety of loading conditions were proven accurate by the model tests.

What is claimed is:

1. In an improved composite tension member, a plurality of end-to-end segments having a longitudinal center of gravity, each segment including a pair of wood beams fastened together in face-to-face engagement, said segments comprising an elongated compression portion, said segments meeting at included angles to each other of less than 180°, said segments providing a longitudinal passageway extending therethrough;

elongated tension means disposed in said passageway, said tension means paralleling and being symmetrical relative to said longitudinal center of gravity and engaging the ends of said compression portion, said tension means being normally under a preloading predetermined tension in sufficient magnitude to press against the ends of said compression portion to place and maintain said compression portion under compressive stress throughout the application of all contemplated external tension loading conditions on said tension member, thereby causing both said tension means and said compression portion to cooperate in resisting lengthening of the assembly rather than said tension means alone, thus lessening such elongation, said tension means including a pair of abutment members engaging the extreme outer ends of said compression portion, said tension means also including anchoring devices abutting said abutment members;

and at least one connecting means engaging the tension means and the end portions of the compression segments to prevent crushing of the compression portion by the tension means.

2. The composite tension member of claim 1 wherein the connecting means are metal plates fitting in slots in the end portions of the segments.

3. The composite tension member of claim 1 including a plurality of bearing plates abutting the ends of the segments and accommodating passage of the tension means.

4. In a truss, a compression chord, a pair of end assemblies each having a first abutment engaging one end of the compression chord and also including a second abutment, a prestressed tension chord including a compression portion in abutment with the second abutments and having at least one passage extending therealong, the tension chord also including at least one tension means extending along the passage or passages and secured to the second abutments under tension to preload the compression portion to an amount sufficient to maintain it under compression under all contemplated external loading conditions on the truss, the compression portion including a plurality of segments forming angles with each other of less than 180°, the tension chord also including connecting means engaging the tension means and the end portions of the compression segments at the joints thereof to prevent crushing of the compression portion by the tension means, and at least one web connected to the compression chord and the tension chord.

5. The truss of claim 4 wherein the connecting means comprise a plurality of plates, the end portions of the compression segments having the plates embedded therein.

6. The truss of claim 5 wherein each compression segment has slots therein receiving the plates.

7. The truss of claim 4 wherein each of the end assemblies comprises a pair of straps extending along and fastened to the compression chord, a first abutment plate secured to the straps at points spaced substantially from both ends of the straps, and a second abutment plate spaced from the first abutment plate and facing downwardly below the first abutment plate and secured to the straps.

8. In a truss, a compression chord, a pair of end assemblies each having a first abutment engaging one end of the compression chord and also including a second abutment, a prestressed tension chord including a plurality of segments angularly abutting each other and having longitudinally extending passages to accommodate the tension means, said segments having at least one longitudinal passage therethrough, the tension chord including tension means centered relative to the center of gravity of said segments and extending along the passage or passages and secured to the second abutments under sufficient tension to preload said segments to an amount sufficient to maintain compression under all contemplated external loading conditions on the truss, a plurality of pads between the end portions of said segments, and at least one web connected to the compression chord and the tension chord.

9. In a truss, a compression chord, a pair of end assemblies each having a first abutment engaging one end of the compression chord and also including a second abutment, a prestressed tension chord including a plurality of segments angularly abutting each other and having longitudinally extending passages to accommodate the tension means, the tension chord including tension means centered relative to the center of gravity of the segments and extending along the passage and secured to the second abutments under sufficient tension to preload the segments to an amount sufficient to maintain compression under all contemplated external loading conditions on the truss, at least one metal plate positioned between the end portions of each of the segments and engaged by the ends thereof, and at least one web connected to the compression chord and the tension chord.

* * * * *